US007287455B2

(12) United States Patent
Key-Carniak et al.

(10) Patent No.: US 7,287,455 B2
(45) Date of Patent: Oct. 30, 2007

(54) SAFETY PANEL FOR HANDGUNS

(76) Inventors: Marianne M. Key-Carniak, 150 Lange Dr., Troy, MI (US) 48098; Fred D. Vincent, IV, 46649 Greenbriar, Chesterfield, MI (US) 48051

( * ) Notice: Subject to any disclaimer, the term of this patent is extended or adjusted under 35 U.S.C. 154(b) by 134 days.

(21) Appl. No.: 10/709,660

(22) Filed: May 20, 2004

(65) Prior Publication Data

US 2005/0268515 A1 Dec. 8, 2005

(51) Int. Cl.
*F41C 23/00* (2006.01)

(52) U.S. Cl. ..... 89/36.01; 42/71.02; 42/90; 89/1.1

(58) Field of Classification Search ..... 42/71.02, 42/90, 70.01; 89/195, 36.01, 1.1
See application file for complete search history.

(56) References Cited

U.S. PATENT DOCUMENTS 3,685,194 A * 8/1972 Coon ..... 42/77
4,862,618 A * 9/1989 Szabo ..... 42/7
4,999,941 A 3/1991 Farrar ..... 42/71.02
5,566,488 A * 10/1996 Yap ..... 42/49.02
5,621,997 A * 4/1997 Pearce ..... 42/71.02
5,797,207 A * 8/1998 Marable et al. ..... 42/71.02
6,055,758 A * 5/2000 Vieweg ..... 42/7
6,073,381 A * 6/2000 Farrar et al. ..... 42/71.02

OTHER PUBLICATIONS

Silencers, Snipers & Assassins by Truby, 1972, p. 34.*
Pages 1 and 12 from Brownells "New Products" catalogue.

* cited by examiner

*Primary Examiner*—J. Woodrow Eldred
(74) *Attorney, Agent, or Firm*—Richard D. Fuerle

(57) ABSTRACT

A safety panel is attachable to the grip of a handgun that stores rounds in the grip and that has at least one opening in the frame of the grip through which hot gases and shrapnel may pass in a blowout. The safety panel is a plate that completely covers the openings and that has no apertures through it in a portion that is over an opening. The plate may have screw holes through it for attaching it to the frame. It also may have indentations in its periphery for an ambidextrous thumb safety, a mainspring housing pin, and a magazine release clearance. The safety panel is attached to the grip of the gun by removing the grip cover, inserting the safety panel in between the frame and the grip cover, and re-fastening the grip cover to the frame.

19 Claims, 4 Drawing Sheets

SAFETY PANEL FOR HANDGUNS

BACKGROUND OF INVENTION

This invention relates to handguns that store ammunition within the frame of the grip and that have one or more openings in that frame. In particular, it relates to a safety panel that is inserted in between the grip cover and the frame to protect the user of the handgun should ammunition within the grip explode.

In automatic and semi-automatic handguns, ammunition is stored in the grip of the gun. As bullets are fired, a spring mechanism forces bullets up into the barrel of the gun. In some designs for these guns, the frame of the gun, which holds the bullets within the grip, has one or more openings in each side. For example, the 1911 design for a 45 caliber semi-automatic by John Browning (see FIGS. 3 and 4), which was produced and sold by Colt Manufacturing and other companies, has a large aperture in each side of the frame. The purpose of these apertures is to reduce the weight of the gun and reduce manufacturing costs.

Normally, an aperture in the frame of a gun that stores ammunition in the grip does not present any problems. However, if a defective bullet is fired; those apertures can result in injury to the shooter. For example, in a squib load, a round is loaded with only the primer in it. When the round is fired, the ignition of the primer may cause the bullet to leave its casing but remain in the barrel and block the next shot, which causes a "blowout" back towards the shooter. A blowout may also occur if a round is loaded with a double charge of gun powder, or if the round has been reloaded several times, weakening the casing, or if the round is improperly loaded in the gun. If a blowout occurs, it may, in turn, ignite a bullet stored in the chamber in the grip and, when that bullet ignites, it may ignite other bullets in the chamber, causing the grip of the gun to explode. If there is an aperture in the frame of the grip, hot gases and shrapnel under great pressure will pass through the aperture. If the grip panel that covers the aperture is made of plastic, wood, or a thin or weak metal, then bits of plastic, wood, and/or metal will be impelled at high velocities into the hand and possibly the face of the shooter.

U.S. Pat. No. 4,999,941 shows an example of a gun where the bullets are stored within the grip. A stiffening plate 34, which may be stainless steel, is provided in the grip, but there are numerous apertures in the stiffening plate through which hot gasses and shrapnel could pass in a blowout.

SUMMARY OF INVENTION

We have found a way to protect gun users from the ignition of ammunition stored in the grip of guns that have apertures in their frames. In this invention, a safety panel that covers the apertures is inserted between the grip covers and the frame. Should a blowout occur, the safety panel retains its shape and distributes the pressure more evenly to absorb the shock and prevent shrapnel and grip fragments from being impelled into the hand or face of the user. The high pressure gases from the explosion escape (leak out) through small openings in the gun and do not harm the user.

The safety panels of this invention are thin and do not detract from the appearance or utility of the gun. The safety panels may be identical so that a single safety panel can be used on either side of the gun. The panels may also have indentations in their peripheries so that they can be used on a variety of different types of grips.

DETAILED DESCRIPTION

Figure 1:
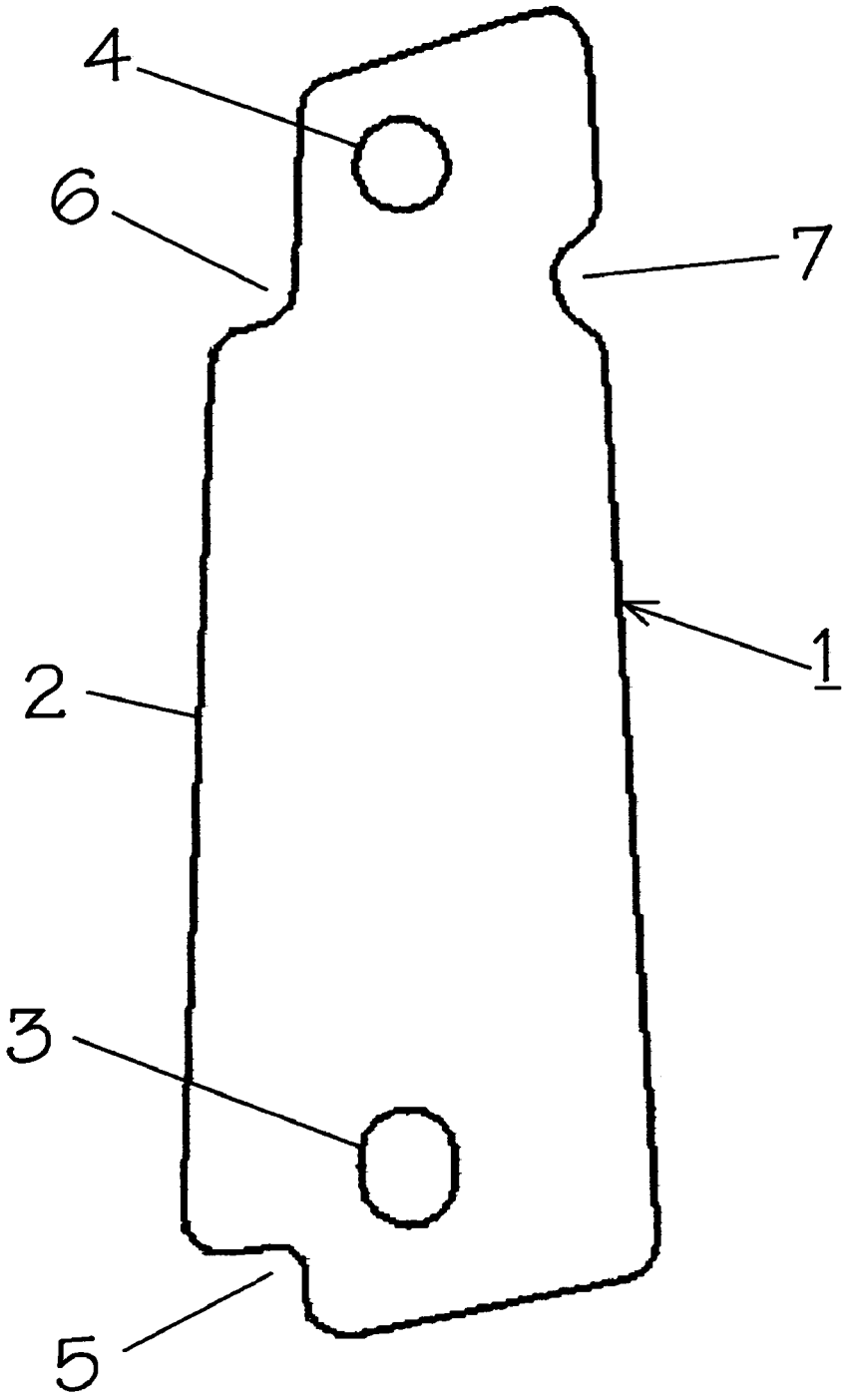
FIG. 1 is a side view of a certain presently preferred embodiment of a safety panel according to this invention.

FIG. 1 shows a safety panel 1 that may be used on either the left or right side of most automatic and semi-automatic handguns. Safety panel 1 comprises a flat plate 2 that will absorb the shock of exploding ammunition without shattering or permitting shrapnel to pierce it. Stainless steel is the preferred material due to its toughness, durability, resistance to corrosion, and relatively low cost. However, other materials may also be used that can provide protection, such as other metals (e.g., steel, brass), composite materials (fiberglass, graphite fiber composites), and materials used for bullet-proof vests (e.g., synthetic plastics). The thickness of panel 1 will depend upon the properties of the material from which it is made. A stainless steel panel may be about 0.010 to about 0.030 inches thick.

Safety panel 1 is provided with two apertures 3 and 4 through which screws pass to hold it to the frame of the gun. Most guns require two screws in the grip, but a gun may require only a single screw or more than two screws, in which case panel 1 may have an aperture for each screw. However, there are no apertures through safety panel 1 in the area that will cover an aperture in the frame of a gun.

Safety panel 1 also has three indented portions, 5, 6, and 7 which enable it to be used on a variety of different types of guns. Indented portion 5 is for a mainspring housing pin clearance, indented portion 6 is for an ambidextrous thumb safety, and indented portion 7 is for a magazine release clearance, which is normally on the right side of the gun. These indentations enable safety panel 1 to be attached to either side of handguns that require clearance for the mainspring housing pin, that have an ambidextrous thumb safety, or that require clearance for a magazine release. Preferably, the safety panel 1 that is attached to the right side of the grip of a gun is identical to the safety panel 1 that is attached to the left side of the gun.

Figure 2:
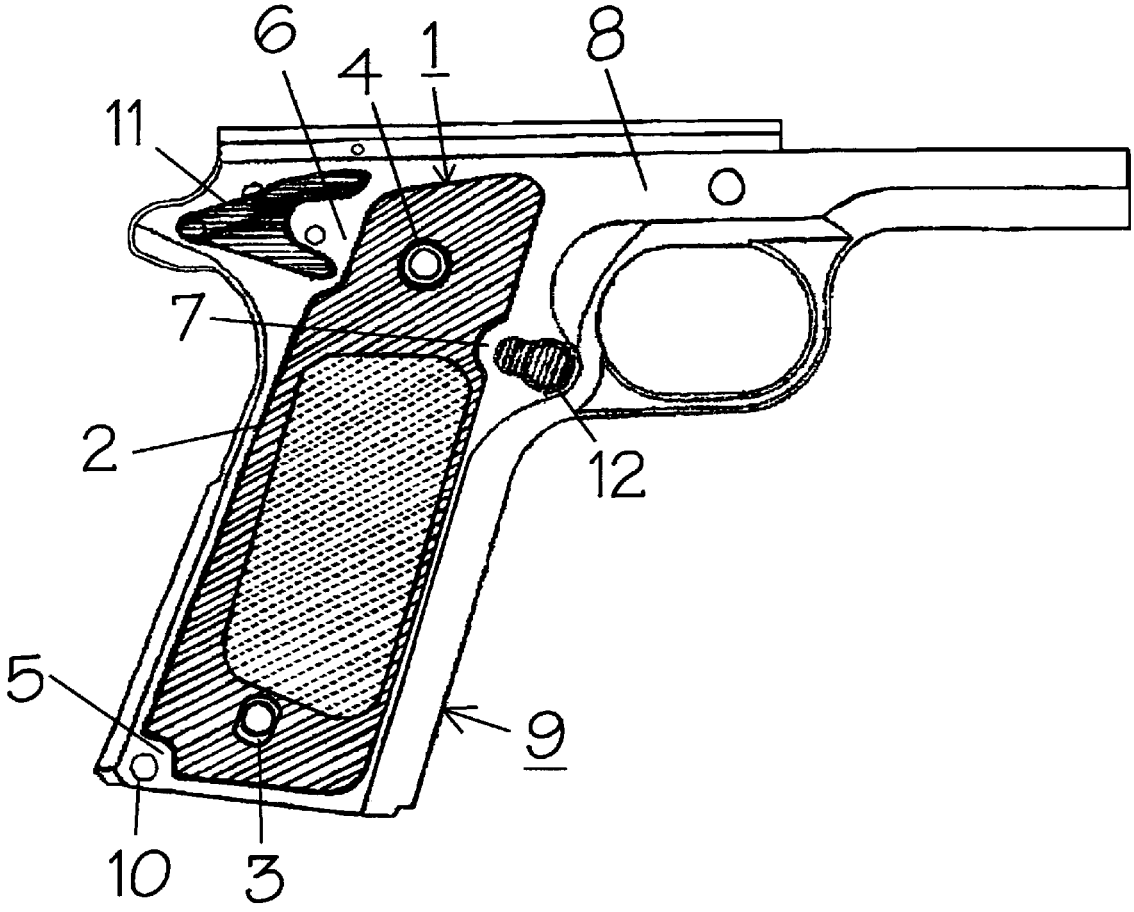
FIG. 2 is a right side view, partially cut-away, of a semi-automatic handgun showing the position of an installed safety panel according to this invention.

In FIG. 2, handgun 8 has a safety panel 1, as shown in FIG. 1, attached to grip 9. Mainspring housing pin 10 fits into indented portion 5, ambidextrous thumb safety 11 fits into indented portion 6, and magazine release 12 fits into indented portion 7.

Figure 3:
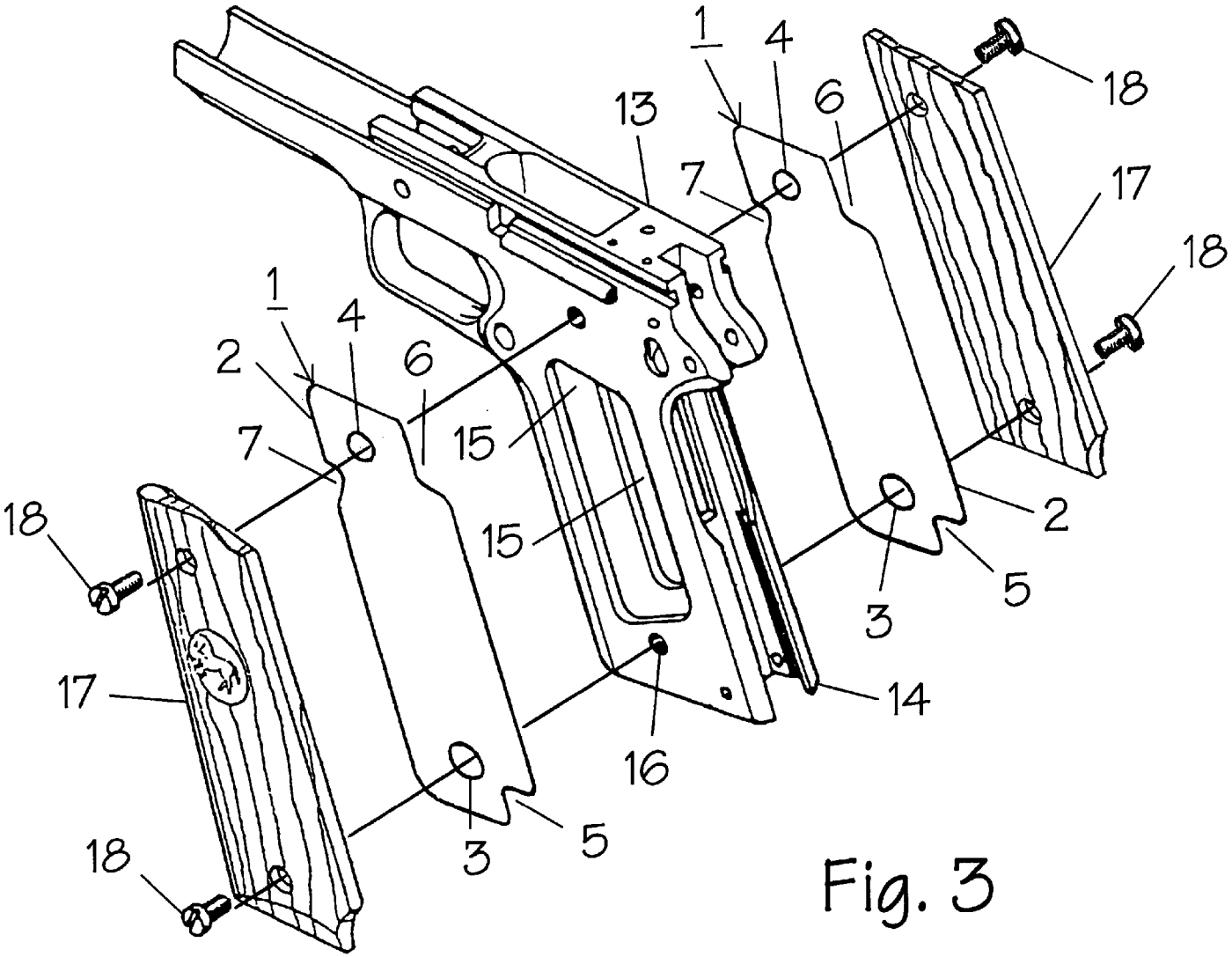
FIG. 3 is an isometric exploded view of a disassembled handgun, showing how safety panels according to this invention are attached to a handgun.

FIG. 3 shows a stripped-down semi-automatic handgun and illustrates how the safety panels of this invention are attached to the frame. In FIG. 3, handgun frame 13 has a grip portion 14 in which are stored rounds (not shown). Grip portion 14 has a large aperture 15 in each side. There are two threaded screw holes 16 in each side of frame 13 so that decorative grip covers 17 can be attached to it by means of screws 18. In between frame 13 and decorative grip cover 17 are two safety panels 1, as illustrated in FIG. 1.

Figure 4:
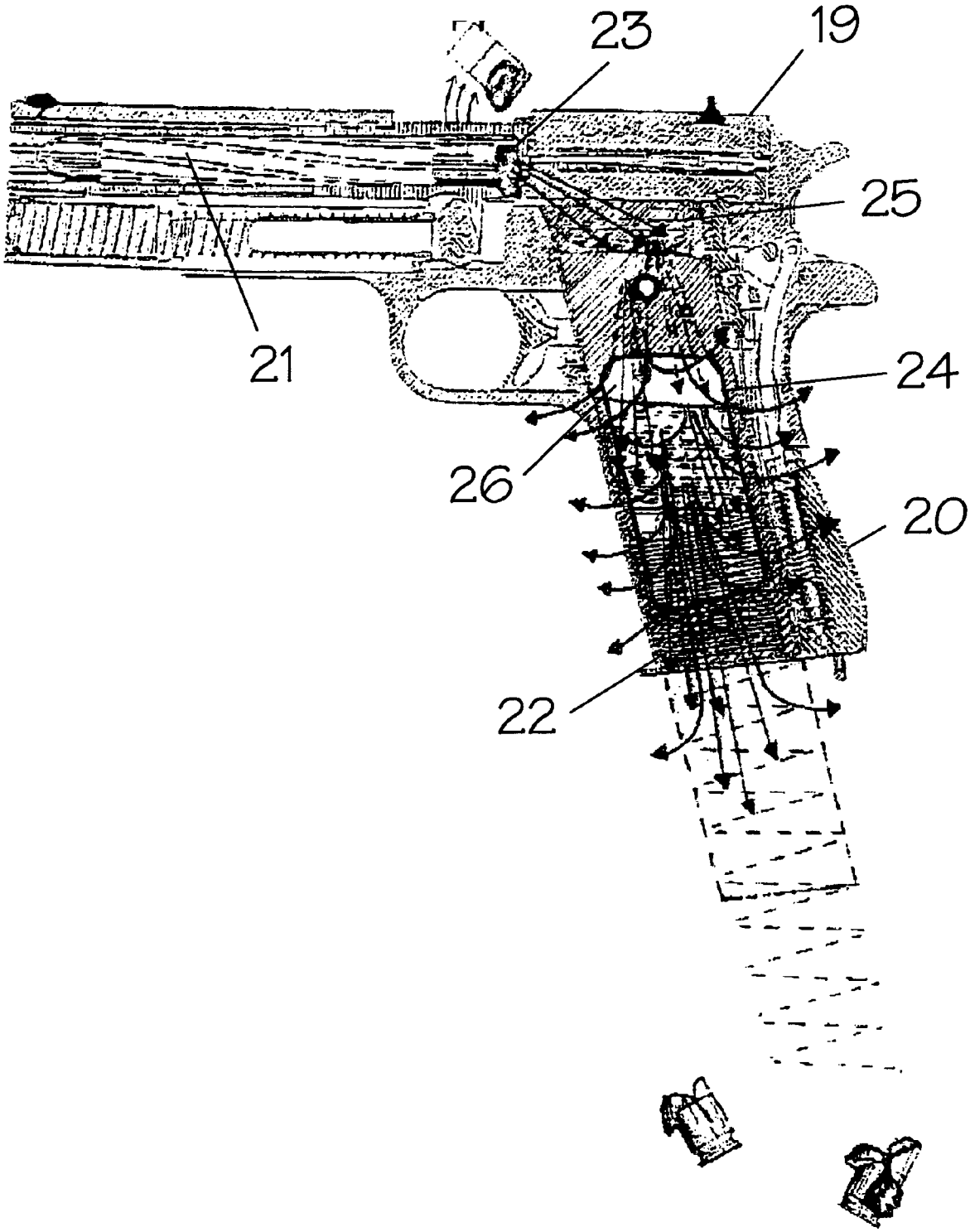
FIG. 4 is a side view, in section, of a handgun, illustrating a blowout within the grip.

In FIG. 4, semi-automatic handgun 19 has a grip 20 in which are stored rounds that are forced into barrel 21 by spring 22 as they are fired. The arrows in the drawing illustrate how a blowout occurs when round 23 discharges back into the chamber 24 holding other rounds 25, igniting them and causing an explosion to occur within grip 20, permitting hot gases and shrapnel to pass though openings 26 in grip 20.

EXAMPLE

A safety panel according to this invention was installed between the grip cover and the frame of a 1911 style, 45 caliber semi-automatic handgun. The safety panel was a 0.010 inch thick stainless steel plate as shown in FIG. 1. By accident, a blowout occurred when the gun was fired. The shooter was not injured.

In contrast, another shooter fired a 1911 style, 45 caliber semi-automatic handgun that did not have a safety panel according to this invention installed. By accident, a blowout occurred due to a double charge of powder in a round. The shooter received cuts to his face and hands. Metal and wood fragments were found embedded below the skin of his hands and face.

The invention claimed is:

1. A safety panel attachable to the grip of a handgun that stores rounds in said grip, that has at least one opening in the frame of said grip through which hot gases and shrapnel may pass in a blowout, and that has a grip cover on each side of said grip attached to said grip over said at least one opening, said safety panel comprising a plate for each side of said grip that (1) completely covers said at least one opening;

(2) fits entirely underneath said grip cover; and (3) has no apertures therethrough in a portion that is over said opening, where said plate has screw holes therethrough for attaching it to said frame and indentations in its periphery for (A) an ambidextrous thumb safety;

(B) a mainspring housing pin; and (C) a magazine release clearance.

2. A safety panel according to claim 1 wherein said plate is made of metal.

3. A safety panel according to claim 2 wherein said plate is made of steel.

4. A safety panel according to claim 3 wherein said plate is made of stainless steel.

5. A safety panel according to claim 4 wherein said plate is about 0.010 to about 0.030 inches thick.

6. A safety panel according to claim 1 having two screw holes.

7. A method of preventing injury to a person firing a handgun that stores ammunition in a frame in its grip, where a grip cover is fastened to said frame and said frame has at least one aperture through which hot gases and shrapnel from a blowout can pass, comprising (A) removing said grip cover;

(B) inserting a safety panel according to claim 1 in between said frame and said grip cover; and (C) re-fastening said grip cover to said frame.

8. A handgun having a grip in which ammunition is stored before it is loaded into the barrel of said gun, said grip comprising (A) a frame having at least one opening through which hot gases and shrapnel in said grip may pass in a blowout;

(B) a grip cover on each side of said frame;

(C) attachment means for fastening said grip covers to said frame; and (D) a safety panel between said frame and each grip cover, said safety panels comprising two plates having no apertures therethrough over said at least one opening, where each plate fits entirely beneath a grip cover.

9. A handgun according to claim 8 wherein said plate is made of stainless steel.

10. A handgun according to claim 9 wherein said plate is about 0.010 to about 0.030 inches thick.

11. A handgun according to claim 8 wherein said plate has indentations in its periphery for (A) an ambidextrous thumb safety;

(B) a mainspring housing pin; and (C) a magazine release clearance.

12. A handgun according to claim 8 wherein said safety panels are identical.

13. A handgun according to claim 8 wherein said frame has a single aperture through each side of said grip.

14. A handgun according to claim 8 wherein said attachment means is two screws.

15. A handgun according to claim 8 that is a semi-automatic.

16. A handgun according to claim 8 that is automatic.

17. A handgun according to claim 8 that is a 1911 style by John Browning.

18. A handgun according to claim 8 that has ammunition stored in its grip.

19. A semi-automatic handgun having a grip in which ammunition is stored before it is loaded into the barrel of said gun, said grip comprising (A) a frame having a single aperture through each side;

(B) a grip cover on each side of said frame, each grip cover having two screw holes therethrough;

(C) a safety panel between said frame and each grip cover, said safety panels comprising identical flat metal plates made of stainless steel about 0.010 to about 0.030 inches thick, each plate having only two screw holes therethrough and no apertures therethrough over said single aperture, each plate fitting entirely beneath a grip cover, said plates having indentations in their periphery for (1) an ambidextrous thumb safety;

(2) a mainspring housing pin; and (3) a magazine release clearance; and (D) a screw passing though each said screw hole to attach said grip covers and safety panels to said frame.

* * * * *